US005312694A

United States Patent [19]

Sugawara

[11] Patent Number: 5,312,694

[45] Date of Patent: May 17, 1994

[54] MATERIAL FOR CATALYZER FOR PURIFICATION OF EXHAUST GAS AND CATALYZER USING SUCH A MATERIAL

[75] Inventor: Minoru Sugawara, Kanagawa, Japan

[73] Assignee: Ishino Corporation Co., Ltd., Tokyo, Japan

[21] Appl. No.: 963,105

[22] Filed: Oct. 19, 1992

[30] Foreign Application Priority Data

Oct. 17, 1991 [JP] Japan ..... 3-92677
Dec. 17, 1991 [JP] Japan ..... 3-352841
Dec. 18, 1991 [JP] Japan ..... 3-359692

[51] Int. Cl.[5] ..... B01J 35/04; B01D 53/36; F01N 3/28

[52] U.S. Cl. ..... 428/592; 428/597; 502/527; 502/439; 422/180

[58] Field of Search ..... 428/592, 597; 502/527, 502/439; 422/180; 261/113, 100, DIG. 72

[56] References Cited

U.S. PATENT DOCUMENTS 1,561,044 11/1925 Alexander ..... 261/113
2,045,632 6/1936 Colby ..... 502/527
2,206,440 7/1940 Walker ..... 261/112.1
2,321,719 6/1943 Wesk ..... 261/113
2,692,019 10/1954 Zalkind ..... 428/597
3,116,120 12/1963 Koskinen ..... 428/597
3,716,344 2/1973 Ashburn ..... 422/180
4,152,302 5/1979 Nonnenmann et al. ..... 502/527
4,455,281 6/1984 Ishida et al. ..... 502/527
4,676,934 6/1987 Seah ..... 261/112.2
4,987,034 1/1991 Hitachi et al. ..... 502/439
5,011,810 4/1991 Mishimoto et al. ..... 502/527
5,045,403 9/1991 Maus et al. ..... 502/439

OTHER PUBLICATIONS

Abstract for West. German Publication 3515681, Nov. 1986.

*Primary Examiner*—John Zimmerman
*Attorney, Agent, or Firm*—DeLio & Peterson

[57] ABSTRACT

This invention provides a material for a catalyzer for purifying the exhaust gas using metallic carrier and the catalyzer using said material. The material for the catalyzer is formed by providing a plurality of tabs protruding from one side surface or either side surfaces of a heat-resisting metallic thin plate such as made of a heat-resisting ferritic stainless steel. The catalyzer is formed by winding spirally or bending in the zig-zag form the material for the catalyzer solely or in combination with another metallic plane plate so as to be formed in the desired size and shape. The exhaust gas flowing through the space between the opposing portions of the metallic thin plate is rendered to be turbulent flow by virtue of the provision of the tabs thereby insuring the time necessary for receiving the heat from the exhaust gas to be obtained, while the temperature of the catalyzer can be quickly raised by virtue of the shape of the tips of the tabs tending to be easily heated so that the time required for the activation of the catalyzer can be constructed.

8 Claims, 5 Drawing Sheets

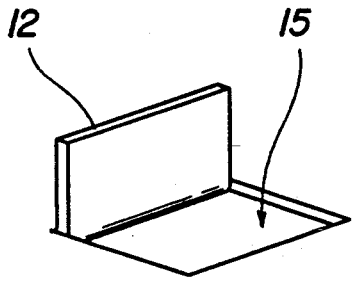
FIG. 9a
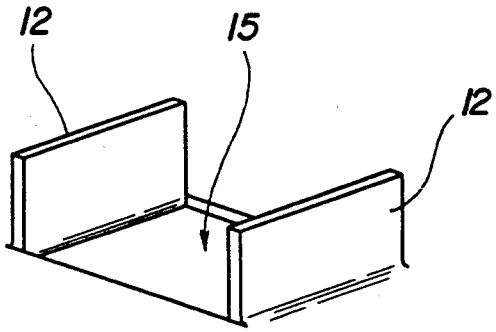
FIG. 9b
FIG. 9c
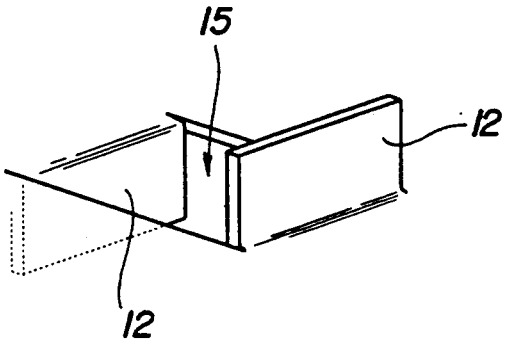

MATERIAL FOR CATALYZER FOR PURIFICATION OF EXHAUST GAS AND CATALYZER USING SUCH A MATERIAL

TECHNICAL FIELD OF THE INVENTION

This invention relates to a catalyzer for purifying exhaust gas from an internal-combustion engine utilized in an automobile and the like, and particularly to a catalyzer for purification of the exhaust gas using a metallic carrier.

BACKGROUND OF THE INVENTION

Recently, problems of air pollution due to the exhaust gas especially from automobiles have become serious, and the need for catalyzers for purification of air has become more severe. To this end, changes in catalyzers are being intended from those using ceramic carriers heretofore used to those using metallic carriers which have far superior purification characteristics. As the material for the metallic carriers, there are ferritic heat-resisting stainless steels including aluminum based stainless steel of 20 wt % Fe and 5 wt % Cr etc.

The plates made of such a heat-resisting stainless steel is generally formed in honeycomb structure and is used in the exhaust gas systems of an engine. However, the catalyzers using the metallic carriers are not activated when they are in a cooled state, i.e. in the so-called "cold start", so that sufficient purifying action can not be achieved.

As measures for enhancing the efficiency of the catalyzer in the cold start, there have been proposed means for preheating the catalyzer by flowing the electric current through the metallic carrier thereof so as to start the engine under the condition in which the activation of the catalyzer is raised, and means for forming novel honeycomb structure in which the plane plate portion are formed in a finely corrugated shape or the plane plates are replaced solely by corrugated plates so that the rising speed of the temperature of the catalyzer caused by the exhaust gas is accelerated to thereby shorten the time required for activation of the catalyzer.

However, in the former case in which the catalyzer is preheated, the electric power consumed thereby is very great such as 4.5–5 kw in the case of the catalyzer of small size passenger vehicle even though sufficient purification action is achieved. Therefore, it becomes necessary to prepare a separate battery for preheating the catalyzer, which means the retrogradation to the weight reduction of the automobile. Further, in the later case in which the honeycomb structure is modified, it is insufficient to meet, for example, the final value set in the regulation (quantity of exhaust of HC per 1 mile traveling controlled to max. 0075 g) enacted in California, U.S.A. in October 1990.

SUMMARY OF THE INVENTION

This invention proposes to provide a material for a catalyzer for purification of exhaust gas which enable to shorten the time required for achieving activation of the catalyzer by forming a novel structure distinguishing it from the prior art honeycomb structure so as to raise the purifying rate at the cold start and the catalyzer using such a material.

This invention proposes also to provide a material for a catalyzer for purification of exhaust gas which can be produced in more simple manner in comparison with the prior art catalyzer of the honeycomb structure to thereby provide a catalyzer capable of being produced in lower cost.

The material for the catalyzer for purification of exhaust gas in accordance with this invention is formed with tabs protruding from at least one side surface of a heat-resisting metallic thin plate such as ferritic stainless steel. These tabs may be formed so as to protrude from either side surfaces of the metallic thin plate.

The catalyzer for purification of exhaust gas in accordance with this invention is formed by winding spirally a heat-resisting metallic thin plate made of heat-resisting ferritic stainless steel and the like in which said tabs are formed, so as to form desired size and shape.

The catalyzer for purification of exhaust gas in accordance with this invention is also formed by superposing upon each other a heat-resisting metallic thin plate such as a heat-resisting ferritic stainless steel and the like in which tabs are formed so as to protrude from either side surface thereof and another metallic plane plate having no tabs and winding them spirally or bending them in zig-zag form so as to form desired size and shape.

Preferably, the metallic thin plate formed with said tabs is provided with projection or beads arranged at appropriately spaced relationship to each other and each having a protruding height equal to or slightly greater than the height of said tabs.

These tabs formed in the metallic thin plate are positioned in protruding relationship to the flow of the exhaust gas. Thus, the flow of the exhaust gas is disturbed at positions where the tabs are formed thereby insuring the time during which the transmission of heat from the exhaust gas to the metallic thin plate, while the temperature rise at the tips of the tabs is remarkably increase thereby permitting the activation of the catalyzer to be expedited.

When the metallic plane plate used together with the metallic thin plate formed with tabs in its both side surfaces is superposed upon the metallic thin plate having the tabs, it functions as a kind of spacers for preventing the flow paths of the exhaust ga from being blocked which might be caused by the fact that the tabs get tangled together. At the same time, the metallic plane plate acts as a kind of the flow rectifying plate for preventing the flow of the exhaust gas from being excessively disturbed by the tabs and the holes formed by providing the tabs.

When the metallic thin plate is formed in spiral form or zig-zag form solely or together with the metallic plane plate, the space forming the flow path of the exhaust gas between the adjacent metallic thin plate or between the adjacent metallic thin plate and the metallic plane plate is maintained at a determined distance due to the fact that the projections or beads have the projecting height equal to or slightly greater than that of the tabs. At the same time, the projections or beads prevent the tips of the tabs from being collapsed by the metallic plane plate abutting against the tips. Further, when they are provided in the form of beads, the rectifying function of the flow of the exhaust gas is obtained by appropriately selecting the direction of extension of the beads.

Therefore, in accordance with this invention, the material for the catalyzer is very simply produced by forming the tabs in the heat-resisting metallic thin plate such as heat-resisting ferritic stainless steel and the like. Further, since the catalyzer is formed by shaping the metallic thin plate formed with the tabs in the spiral form solely or in combination with the metallic plane plate or by bending the same in zig-zag form so as to be formed in the desired size and configuration, the time required for receiving heat from the exhaust gas is possibly insured by generating the turbulence effectively in the flow of the exhaust gas, and, further, since the tips of the tabs protrude independently from each other, they can be easily heated, thereby permitting the temperature of the catalyzer to be quickly raised so that the time necessary for the catalyzer to be activated can be shortened thereby raising the efficiency of the catalyzer at the cold start.

Further, since the projections having the height equal to or slightly greater than that of the tabs are arranged in the metallic thin plate, the tabs can be positively prevented from being collapsed between the adjacent portions of the metallic thin plate facing against each other by winding spirally or bending in zig-zag form, while the distance between those portions facing against each other can be maintained at a determined distance. Further, the excessive turbulence of the flow of the exhaust gas can be prevented by extending the projections in the direction of flow of the exhaust gas, so that loss of the output of the engine can be suppressed to the minimum.

In addition, since the metallic thin plate can be formed with the tabs by the pressing operation while the catalyzer can be produced by winding the metallic thin plate in the spiral form, the catalyzer can be very simply produced at a lower cost and delivered.

DETAILED DESCRIPTION OF PREFERRED EMBODIMENT

Figure 1:
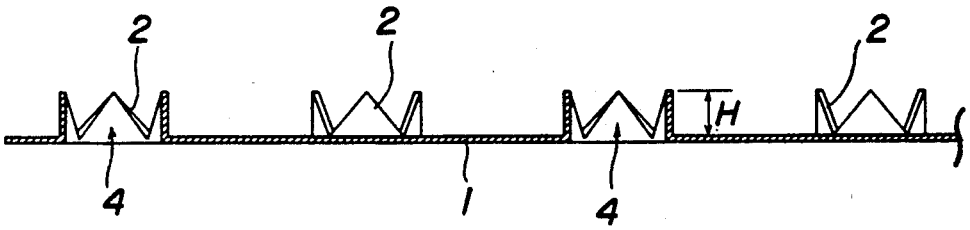
FIG. 1 is a cross-sectional view showing a portion of the material for the catalyzer for purifying the exhaust gas constructed in accordance with an embodiment of this invention.
Figure 2:
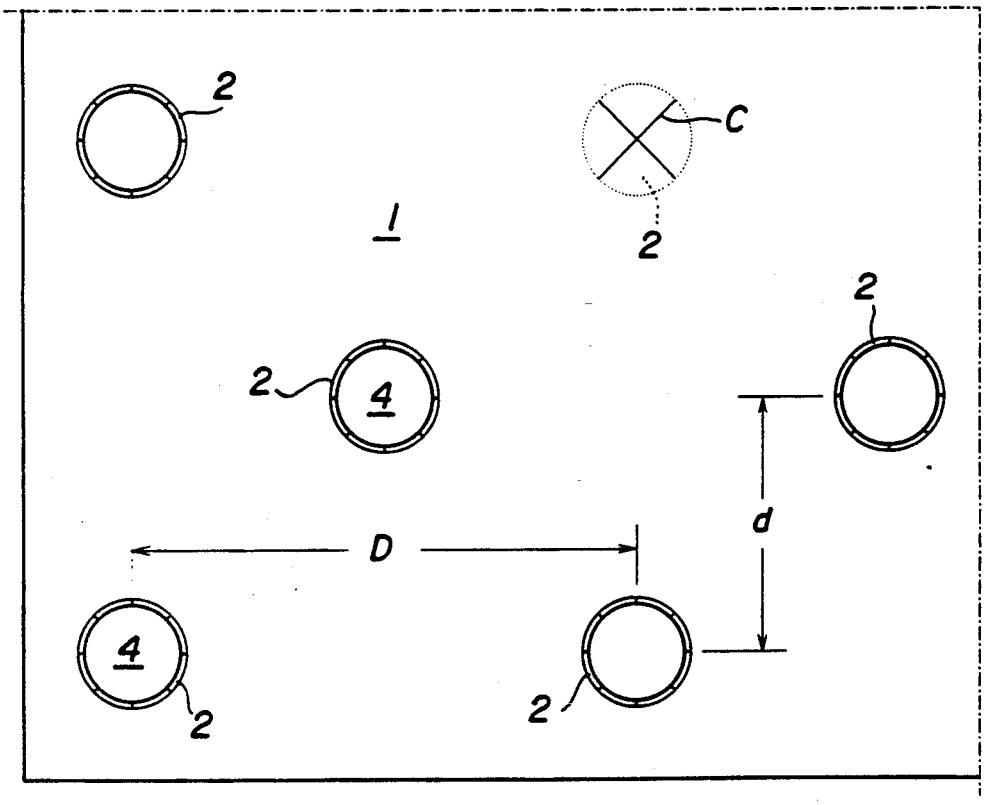
FIG. 2 is a plane view showing a portion of the material shown in FIG. 1, one of the tabs being shown for the purpose of explanation in the state without being worked or in the state on the way to be finished.
Figure 3:
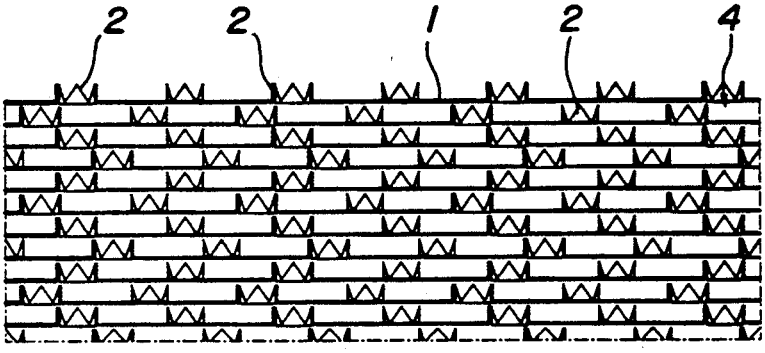
FIG. 3 is a cross-sectional view showing a portion of the catalyzer for purifying the exhaust gas in accordance with the embodiment of this invention prepared by using the material shown in FIGS. 1 and 2.

As shown in FIGS. 1 and 2, the material for the purifying the exhaust gas in accordance with an embodiment of this invention is made from a metallic thin plate 1 in the plate-like shape which is formed with tabs 2 protruding from its one side surface. The metallic thin plate 1 forms the catalyzer for purifying the exhaust gas in the desired size and shape by winding the metallic thin plate 1 in the spiral form as shown in FIG. 3.

The metallic thin plate 1 is made of a thin plate of ferritic heat-resisting stainless steel such as aluminum based stainless steel containing 20 wt % Fe and 5 wt % Cr. The tabs 2 are formed as shown in FIG. 2 by means of die (not shown) by cutting a plurality of cross lines C (three crossing lines shown in the drawing) intersecting each other at a point and pushing the cut portions formed by cutting the cut lines from one side surface of the metallic thin plate 1 outwardly toward the opposite side surface with the crossing point centered at the pushed out portions.

The size and shape of the tabs 2, and a distance therebetween are not specifically limited, but it is preferred in general to set the distance d between the adjacent two rows of tabs to be about 2–3 mm and to set the distance D between the adjacent two tabs in each row to be about 4–6 mm in the case that the tabs each having the protruding height H of about 0.5 mm are arranged in a plural number of rows with each tab in the respective row being positioned intermediate the adjacent two tabs in the adjacent row at each side of said respective row. By such an arrangement of the tabs, as shown in FIG. 3, when the metallic thin plate 1 is wound in spiral form to form the catalyzer of the desired size and shape, the tabs 2 protruding from its one side surface form means for causing turbulence of the flow of the exhaust gas generally about 5–13 % of the regions in the one side surface of the metallic thin plate 1. However, this invention is not necessarily limited to the above value of the turbulence of the flow, but must be selected appropriately so as to suppress the loss of the output of the engine due to excessive impedance against the flow of the exhaust gas, while sufficient heat is received from the exhaust gas.

Figure 4:
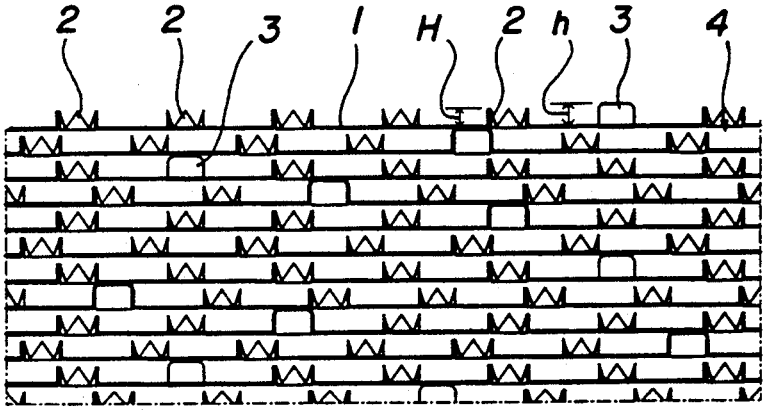
FIG. 4 is a view similar to FIG. 3 but showing an alternative example of the metallic thin plate.

Among the tabs 2 arranged as mentioned above, some of them positioned at appropriate distance from each other are not shaped in the form of a tab, but they are preferably shaped in the form of protruding bent lugs 3 as shown in FIG. 4. The protruding height h of the bent lug 3 is made equal to or slightly greater than the protruding height H of the tab 2. And, the distance between the adjacent two bent lugs 3 may be changed depending upon the final size and shape of the catalyzer intended to be produced, but the spacing between the adjacent two bent lugs 3 may be 30–80 mm in the case that the dimensional relationship of the tabs 2 is made as described previously.

The distance between the portions facing against each other of the spirally wound metallic thin plate 1 is held at a determined spacing by virtue of the tabs 2 and the bent lugs 3 so that flow paths of exhaust gas are formed. On the other hand, the tabs 2 and the lugs 3 are so arranged that they form obstructions against the flow in the flow path of the exhaust gas.

Thus, exhaust gas passing through the space between the opposing portions of the spirally wound metallic thin plate 1 generates turbulence flow therein, while the exhaust gas is permitted to flow through holes 4 formed within each tabs 2 projecting from one side surface of the metallic thin plate toward the opposite side surface, thereby generating further complicated turbulent flow so that the heat from the flowing exhaust gas can be more efficiently received by the catalyzer. Further, since the tips of each tabs 2 protrude as sharply pointed apices, the heat transmitting efficiency from the exhaust gas thereto is remarkably increased. The bent lugs 3 mainly serve to prevent the tabs 2 protruding in the space between the opposing portion of the spirally wound metallic thin plate 1 from being collapsed during the winding operation of the metallic thin plate 1 to form the catalyzer, and also serve to generate the turbulent flow of the exhaust gas and to receive heat therefrom.

Figure 5:
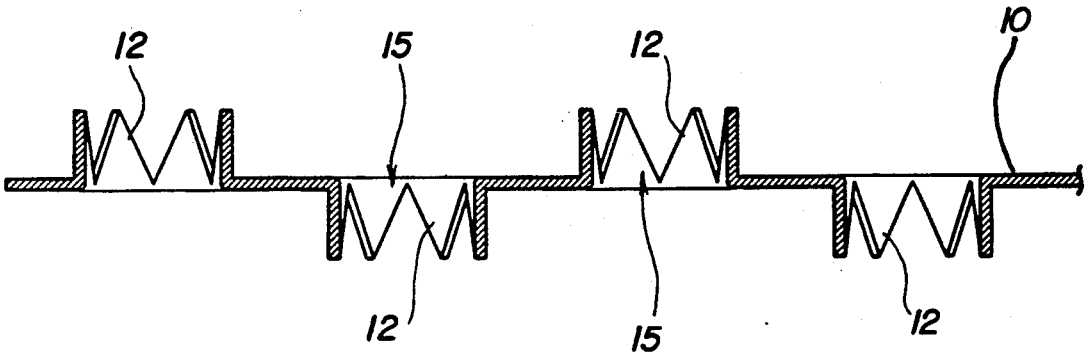
FIG. 5 is a cross-sectional view showing a portion of the material for the catalyzer for purifying the exhaust gas prepared in accordance with another embodiment of this invention.
Figure 6:
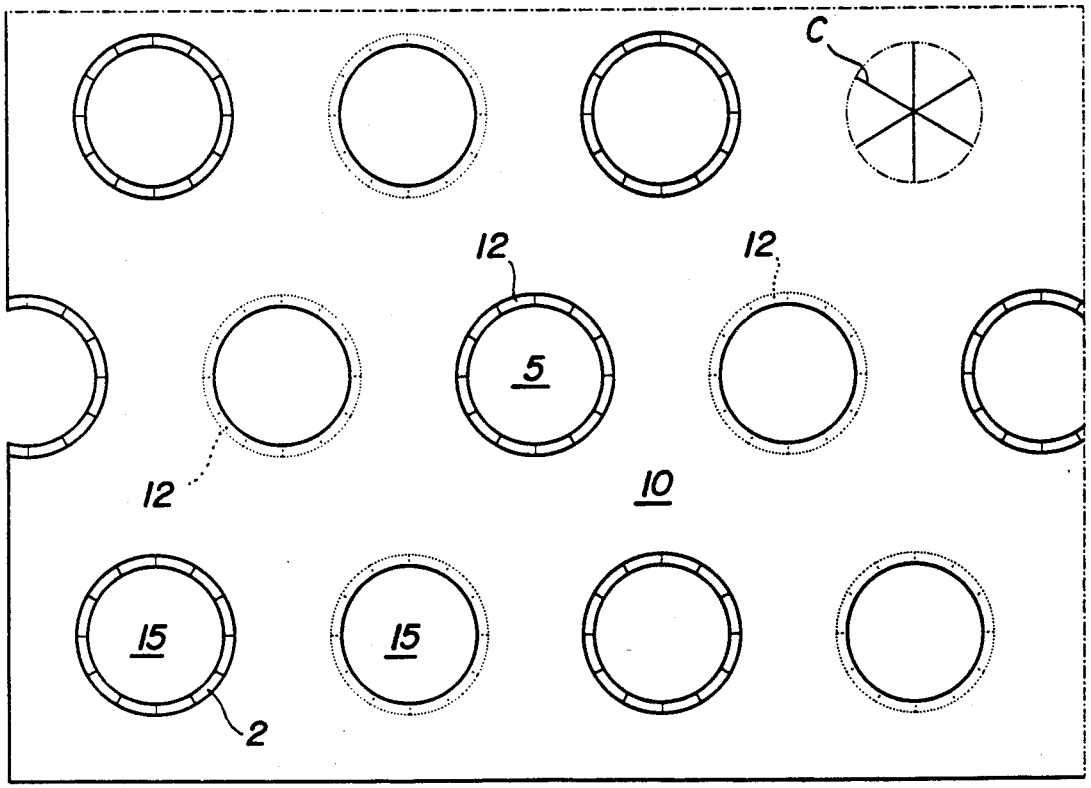
FIG. 6 is a plane view showing a portion of the material shown in FIG. 5, one of the tabs being shown for the purpose of explanation in the state without being worked or in the state on the way to be finished.
Figure 7:
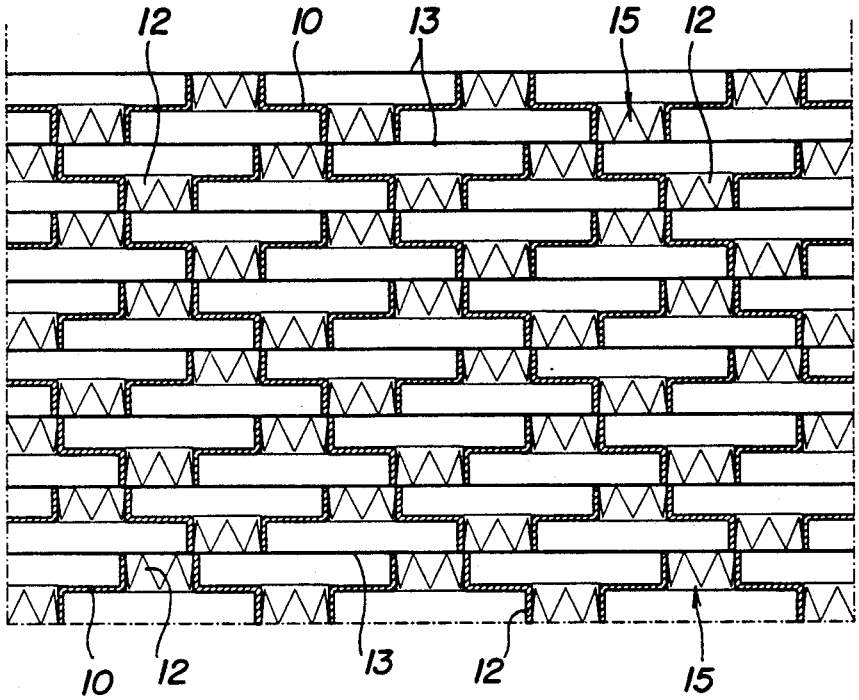
FIG. 7 is a cross-sectional view showing a portion of the catalyzer for purifying the exhaust gas prepared in accordance with another embodiment by using the material shown in FIGS. 5 and 6.

FIGS. 5 and 6 show the material for the catalyzer for purifying the exhaust gas in accordance with another embodiment of this invention, and the tabs 12 formed in the metallic thin plate 10 protrude from either side surfaces of the metallic thin plate 10. As shown in FIG. 7, the metallic thin plate 10 is superposed upon a plane metallic plate 13 having no tabs and is wound spirally together with the plane metallic plate 13 or is bent in zig-zag form together with the plane metallic plate 13 to thereby form the catalyzer for purifying the exhaust gas having the desired size and shape.

The metallic thin plate 10 is formed, as described in the previous embodiment, from a thin plate of ferritic heat-resisting stainless steel such as aluminum based stainless steel containing 20 wt % Fe and 5 wt % Cr. The metallic plane plate 13 is preferably made of the same material as the metallic thin plate 10, but it is at least necessary that it prevents the spacing between the opposing portions of the metallic thin plate 10 and the plane metallic plate 13 when they are spirally wound together or bent in zig-zag form from being rendered to be in uniform due to tangling of the opposing tabs with each other, etc.

As shown in FIG. 6, each tab 12 is formed by providing a plurality of cut lines C intersecting each other at a point (in the case illustrated in the drawing, three lines are formed) in the metallic thin plate 10 and extruding the cut portions from one side surface thereof toward the opposite side surface, but the tabs 12 are protrude from either side surfaces of the metallic thin plate 10 toward the opposite direction, this being the difference from the previously described embodiment. The size and shape as well as the distance between the adjacent two previously described embodiment, and, therefore, detailed description is omitted.

Figure 8:
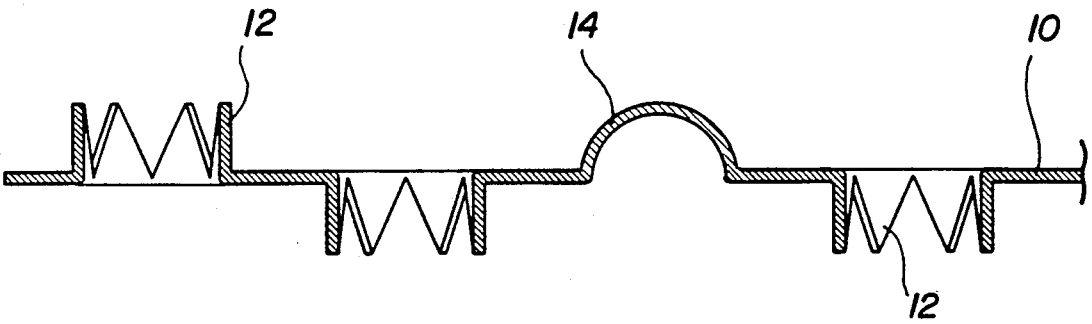
FIG. 8 is a view similar to FIG. 5, but showing a further alternative example of the metallic thin plate, and FIGS. 9(*a*), 9(*b*) and 9(*c*) are perspective views showing various alternative example of the tabs formed in the metallic plate.

Also in this embodiment, among the tabs 12 arranged in the metallic thin plate 10, some of the tabs spaced at an appropriate distance from each other are not in the shape of tab, but are preferably formed in the bent lugs or beads 14 protruding from the metallic thin plate 10 as shown in FIG. 8. The protruding height h of each bent lug or bead 14 is made equal to or slightly larger than the protruding height H of the tab 12. The distance between the adjacent two bent lugs or bead 14 is selected appropriately depending upon the size and shape etc. of the tabs and the spacing between the adjacent two tabs and the final shape and size etc. of the catalyzer to be produced.

The distance between the metallic thin plate 10 and the metallic plane plate 13 superposed upon each other is held at a determined distance by virtue of the provision of the tabs 12 and the bent lugs or the beads 14 so as to form flow passageways of the exhaust gas. On the other hand, the tabs 12 and the bent lug or beads 14 serve as obstructions against the flow of the exhaust gas by the arrangement thereof held standing in the flow passageways of the exhaust gas, so that the heat receiving efficiency from the exhaust gas is enhanced by the turbulent flow and the like caused by the tabs 12 and the holes 15 formed therein in the same manner as in the previously described embodiment.

In each of the embodiment described above, the tabs 2 and 12 are described as protruding in the triangular mountain shape so as to form circular or polygonal shaped holes in the metallic thin plate, however, they may take any form provided that they are in the form of tabs capable of providing portions protruding in the flow path of exhaust gas, while they insure formation of flow path of the exhaust gas between the opposing portions of the metallic thin plate wound spirally or bent in zig-zag form as is clear from the previous description. As example, as shown in FIG. 9 they may be formed in one or two rectangular tabs 2 or 12 protruding from one side surface (refer to FIG. 5 (*a*) and (*b*)), or two rectangular tabs 2 or 12 each protruding from the opposite side surface (refer to FIG. 5 (*c*)).

Further, the bent lugs 3 or beads 14 act to prevent the tabs 2 or 12 from being collapsed between the opposing portions of the metallic thin plate during the winding operation, while they maintain the distance between the opposing portions of the metallic thin plate at a determined distance, but they also serve to generate turbulent flow as well as to receive heat from the exhaust gas in the similar manner as the tabs 2 or 12. Further, the bent lugs 3 or the beads 14 may be formed continuously in the metallic thin plate 1 or 10 in the appropriate extended form in the direction of the flow of the exhaust gas. By selecting appropriately the exhausted form, it is possible that the extended portion performs the rectifying function so that the turbulent flow caused by the tabs, bent lugs or the beads and the holes is prevented from becoming excessively.

I claim:

1. Catalyzer for purifying exhaust gas, characterized in that tabs are formed in a circle around the perimeter of a circular opening in a heat-resisting metallic thin plate, said tabs protruding from at least one side of said metallic thin plate, lugs having a protruding height equal to or slightly greater than the protruding height of said tabs are arranged in said metallic thin plate formed with said tabs, said lugs being arranged in spaced distances from each other, and said metallic thin plate formed with said tabs is spirally wound to form the catalyzer.

2. Catalyzer for purifying exhaust gas according to claim 1 wherein all of the tabs and all of the lugs are formed protruding from the same side surface of said metallic thin plate.

3. Catalyzer for purifying exhaust gas characterized in that a heatresisting metallic thin plate is formed with tabs protruding from opposite side surfaces thereof and another metallic plane plate having no tabs is superposed upon the plate with tabs, lugs having a protruding height equal to or slightly greater than the protruding height of said tabs are arranged in said metallic thin plate formed with said tabs, said lugs being arranged in spaced distances from each other, and the thin superposed plates are spirally wound or bent in zig-zag form so as to form the catalyzer.

4. Material for a catalyzer for purifying exhaust gas comprising:

a heat-resisting metallic thin plate with a plurality of tabs having a body and pointed tips, the tips heating more rapidly to operating temperature than the body of the tab when exposed to the flow of exhaust gas, the tabs protruding from a side of the plate bout the perimeters of a plurality of circular openings in the plate; and a plurality of lugs having a cylindrical outer configuration formed on the same side of the plate as the tabs.

5. A catalyzer for purifying exhaust gas formed from the material of claim 4.

6. A catalyzer for purifying exhaust gas according to claim 5, wherein the thin plate is spirally wound to form concentric layers with an upper surface of the lugs on one layer contacting the thin plate on an adjacent layer.

7. Catalyzer for purifying exhaust gas according to claim 6 wherein the metallic thin plate is a heat-resisting ferritic stainless steel.

8. A catalyzer for purifying exhaust gas according to claim 5 wherein the thin plate with tabs and lugs is alternated with a thin metallic plate having no tabs or lugs.

* * * * *